US006701551B1

(12) United States Patent
Antinori

(10) Patent No.: US 6,701,551 B1
(45) Date of Patent: Mar. 9, 2004

(54) UPHOLSTERED SLAT BOX SPRING/BED

(76) Inventor: Steven J. Antinori, 4908 St. Croix Dr., Tampa, FL (US) 33629

( * ) Notice: Subject to any disclaimer, the term of this patent is extended or adjusted under 35 U.S.C. 154(b) by 0 days.

(21) Appl. No.: 10/253,877

(22) Filed: Sep. 25, 2002

(51) Int. Cl.[7] ..... A47C 23/06
(52) U.S. Cl. ..... 5/236.1; 5/237
(58) Field of Search ..... 5/236.1, 237, 238, 5/655.9, 740, 953

(56) References Cited

U.S. PATENT DOCUMENTS

| | | | | | |
|---|---|---|---|---|---|
| 2,638,606 | A | * | 5/1953 | Austin | 5/239 |
| 3,553,745 | A | * | 1/1971 | Sproll | 5/236.1 |
| 3,716,875 | A | * | 2/1973 | Fehr | 5/655.7 |
| 3,717,376 | A | * | 2/1973 | Lutchansky | 5/238 X |
| 3,967,331 | A | * | 7/1976 | Glassman | 5/236.1 |
| 4,035,853 | A | * | 7/1977 | Platter | 5/695 |
| 4,181,991 | A | * | 1/1980 | Morgan et al. | 5/400 |
| 4,369,535 | A | | 1/1983 | Ekkerink | |
| 4,477,935 | A | | 10/1984 | Griffin | |
| 4,567,615 | A | | 2/1986 | Fanti | |
| 4,589,151 | A | * | 5/1986 | Behrens | 5/237 X |
| 4,638,517 | A | * | 1/1987 | Yang et al. | 5/236.1 |
| 4,644,596 | A | * | 2/1987 | Husler | 5/236.1 |
| 4,752,981 | A | | 6/1988 | Salens | |
| 4,935,977 | A | | 6/1990 | Yamada | |
| 5,070,560 | A | * | 12/1991 | Wilkinson | 5/236.1 X |
| 5,109,558 | A | * | 5/1992 | Di Blasi | 5/236.1 X |
| 5,412,821 | A | * | 5/1995 | Wilkinson | 5/236.1 X |
| 5,487,196 | A | * | 1/1996 | Wilkinson et al. | 5/715 |
| 5,524,307 | A | | 6/1996 | Griffin | |
| 5,638,517 | A | | 6/1997 | Bartek et al. | |
| 5,692,258 | A | * | 12/1997 | Griffin | 5/710 |
| 5,701,653 | A | * | 12/1997 | Rupe | 5/236.1 X |
| 5,983,423 | A | * | 11/1999 | Rupe | 5/236.1 |
| 6,003,176 | A | | 12/1999 | Wasley et al. | |
| 6,219,863 | B1 | | 4/2001 | Loberg et al. | |
| 6,237,170 | B1 | | 5/2001 | Salens | |
| 6,263,528 | B1 | | 7/2001 | Husler | |

FOREIGN PATENT DOCUMENTS

| | | | | |
|---|---|---|---|---|
| DE | 3307435 | * | 9/1984 | 5/237 |
| DE | 3438307 A1 | * | 4/1986 | 5/237 |
| DE | 3546385 | * | 7/1987 | 5/236.1 |
| DE | 3936788 A | * | 5/1991 | 5/237 |
| EP | 563497 A1 | * | 10/1993 | 5/237 |
| FR | 2563096 | * | 10/1985 | 5/236.1 |
| FR | 2645014 A | * | 10/1990 | 5/236.1 |
| GB | 121362 | * | 12/1918 | 5/237 |

* cited by examiner

*Primary Examiner*—Robert G. Santos
(74) *Attorney, Agent, or Firm*—Diller, Ramik & Wight

(57) ABSTRACT

A slat box spring/slat bed includes a polygonal frame spanned by a plurality of spaced substantially parallel concavo-convex slats of flexible material atop uppermost convex surfaces of which rests a piece of synthetic latex foam material. A soft cover is upholstered to the entirety of the latter except for an open bottom to impart a coil spring appearance to the slat box spring. The piece of synthetic latex foam material has a plurality of projections or corrugations which project into selected spaces between the plurality of slits to immobilize the latex foam material relative thereto.

27 Claims, 3 Drawing Sheets

UPHOLSTERED SLAT BOX SPRING/BED

BACKGROUND OF THE INVENTION

A conventional bed of the type utilized in North America generally includes, at a minimum, a box spring and a mattress. Normally, the box spring rests upon and is supported by a bed frame which includes legs or casters. In lieu of a bed frame, a headboard and a foot board are connected by side rails which are in turn spanned by box spring supporting boards upon which rests the conventional box spring. Such conventional box springs are made by utilizing a pair of rectangular wire frames, and connecting therebetween a multiplicity of metal coils thereby forming a box spring assembly which is totally covered by padding and is appropriately upholstered and at times quilted.

Typically, European or Continental beds do not utilize such conventional box springs and instead a frame is spanned by a series of slats atop which is supported a mattress. Such slats are conventionally attached to the bed frame by clips exemplified in U.S. Pat. Nos. 6,263,528 and 6,237,170. Such slat beds are relatively inexpensive to manufacture since they are constructed from wood and exclude the expensive materials and production in manufacturing individual steel frames and coils of conventional box springs which preferably are also upholstered in their entirety.

Though the comfort and longevity of slat beds can exceed those of conventional North American/United States beds at far less cost, slat beds have not found acceptance in North America. The habits and attitudes of North American purchasers and users are either resistive to European slat beds or are unaware of the desirable characteristics thereof. Whatever the reason, European/Continental slat beds have not found acceptance on the North American continent.

SUMMARY OF THE INVENTION

In keeping with the foregoing, a primary object of the present invention is to provide a novel slat bed which is in part defined by a novel slat box spring formed as a polygonal frame by opposite side frame members and opposite front and rear frame members which are spanned by a plurality of space substantially parallel concavo-convex slats constructed from wood or other substantially flexible material. The slats have an uppermost convex surface upon which rests a layer of synthetic foam material. Upholstery, in the form of a soft covering, covers the foam material and the frame members and is also preferably quilted to impart a conventional coil spring box spring mattress appearance to what in reality is a slat box spring/bed.

The polygonal frame of the slat box spring/bed is also substantially open at its bottom to facilitate the connection thereto of legs or to provide a lowermost peripheral edge which rests upon a conventional bed frame or box spring support members spanning side rails of a conventional bed frame.

The layer or covering of synthetic latex foam material also preferably includes corrugations or projections projecting into at least some of the spaces between adjacent spaced slats to maintain the latex foam material relative immobilized absent individual connecting means between the latex foam material and the slats.

In further accordance of the invention, a center frame member is disposed substantially midway between the side frame members and parallel thereto, and the slats are located in spanning relationship between the center frame member and the side frame members between the front and rear frame members of the polygonal frame.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
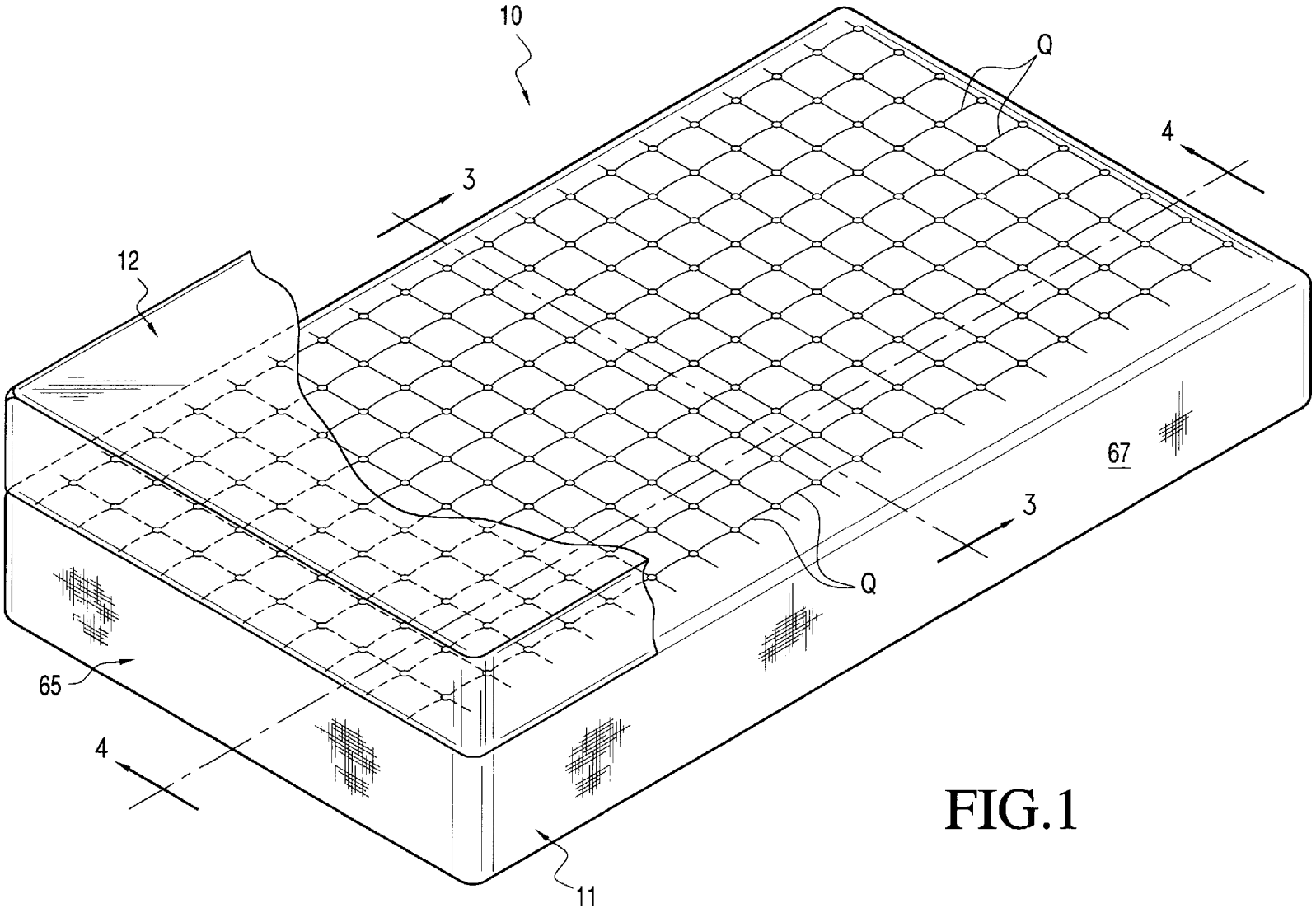
FIG. 1 is a top perspective view with a portion thereof broken away for clarity, and illustrates a slat bed of the invention which includes a slat box spring upon which is supported a conventional mattress.

A novel slat bed constructed in accordance with this invention is illustrated in FIGS. 1 through 4 of the drawings and is designated by the reference numeral 10.

The slat bed 10 includes a slat box spring 11 constructed in accordance with the present invention upon which is supported a conventional mattress 12.

Figure 2:
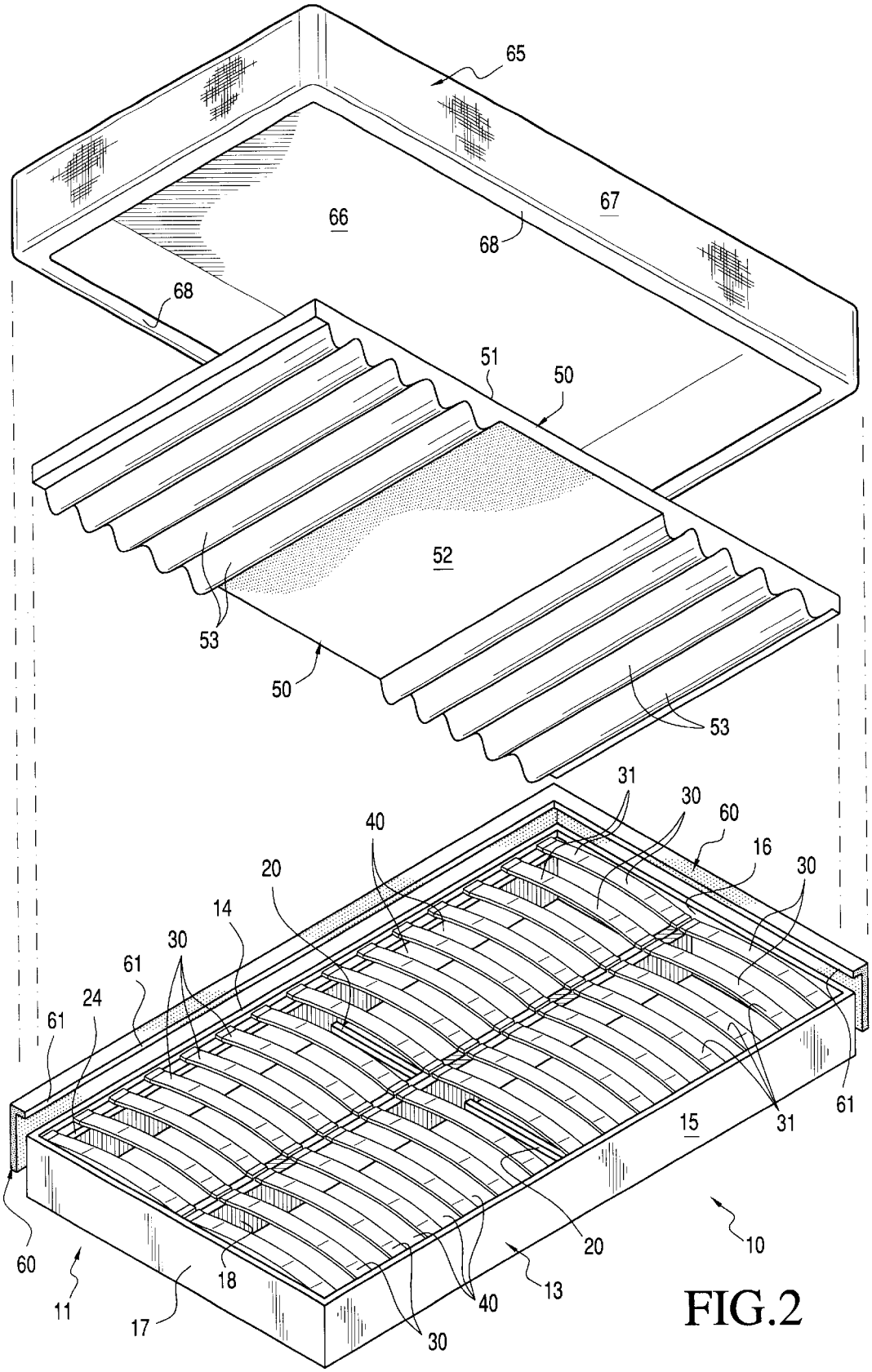
FIG. 2 is an exploded fragmentary view, and illustrates the components of the slat bed including a slat frame, a piece of partially corrugated synthetic latex foam material and a padded cover.
Figure 3:
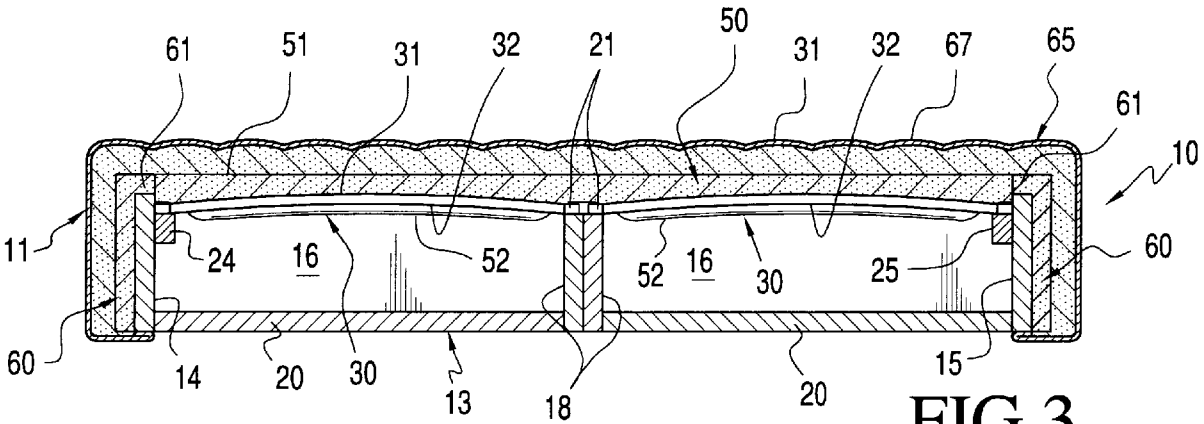
FIG. 3 is an enlarged transverse cross-sectional view taken generally along line 3—3 of FIG. 1 through the slat box frame of the slat bed, and illustrates side and center rails supporting slats atop which rests synthetic latex foam material, and an exterior covering of padded upholstery which is preferably quilted encasing all but an open bottom of the frame.

The slat box spring 11 includes a generally polygonal frame 13 (FIGS. 2, 3 and 4) defined by opposite substantially parallel spaced side frame members 14, 15 (FIG. 3), a head or front frame member 16 (FIGS. 3 and 4) and a foot or rear frame member 17 parallel thereto. A center frame member 18 is located midway between the side frame members 14, 15 (FIGS. 2 and 3) and at opposite ends is connected to the front frame member 16 and the rear frame member 17. The center frame member 18 is preferably of a multi-ply construction for strength and the overall frame 13 is reinforced along its open bottom (unnumbered) by a plurality of reinforcing members 20 which are conventionally connected between the center frame member 18 and the side frame members 14, 15 (FIGS. 2 and 3). Only two such reinforcing members 20 are illustrated in the drawings, but it is to be understood that several other reinforcing members 20 may be connected between the center frame member 18 and the side frame members 14, 15 to achieve the desired rigidity of the polygonal frame 13. An upper edge (unnumbered) of the center frame member 18 is provided with a plurality of upwardly opening notches 21 (FIG. 3) equally spaced along the length of the center frame member 18 between the front frame member 16 and the rear frame member 17. The side frame members 14, 15 (FIG. 3) include respective supporting rails 24, 25.

Figure 4:
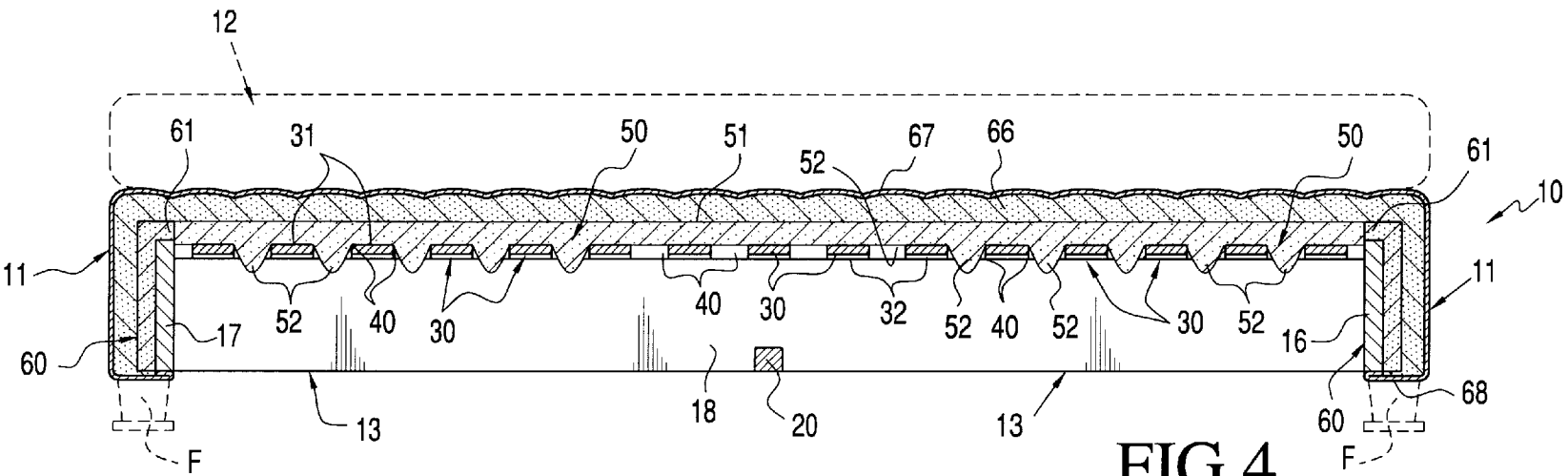
FIG. 4 is an enlarged cross-sectional view taken generally along line 4—4 of FIG. 1, and illustrates ridges, projections or corrugations on an underside of the layer of latex foam material projecting through selected spaces between the slats at foot and head ends of the slat box spring.

A plurality of spaced substantially parallel concavo-convex slats 30 are constructed from substantially flexible material, such as wood, and are disposed substantially within the polygonal frame 13 with opposite ends thereof (unnumbered) supported by the rails 24 or 25 and the center frame member 18 within the slots 21 thereof. Since the slots 21 are equally spaced from each other, the slats 30 are also equally spaced from each other to define a plurality for equally spaced spaces or slots 40 (FIGS. 2 and 4) therebetween. Each slat 30 includes an upper convex surface 31 (FIGS. 2–4) and a lower downwardly facing concave surface 32 (FIGS. 3 and 4).

Seated atop and spanning the slats 30 between the side frame members 14, 15 and the front and rear frame members 16, 17, respectively, is a single piece of synthetic latex foam material 50 (FIGS. 2–4) having a uniplanar upper surface 51 (FIGS. 3 and 4) and a lower central uniplanar surface 52 to either side of which are a plurality of substantially parallel spaced, projecting ridges, corrugations or projections 53. The corrugations 53 seat within selected ones of the slots 40 (FIG. 4) between pairs of slats 30 to thereby immovably unite the latex foam material 50 to the plurality of slats 30.

The exterior surfaces (unnumbered) of the frame members 14 through 16 have adhesively or otherwise secured thereto pads or padding 60 (FIGS. 2–4) in the form of one or more pieces of latex foam material or the like having an uppermost inwardly directed peripheral edge 61 (FIGS. 2 through 4) which rests upon an uppermost edge (unnumbered) of the frame members 14 through 17.

A soft upholstered cover or covering 65 (FIGS. 1–4) encases and covers the entirety of the latex foam material 50, the padding 60 and the frame 13, excluding the open bottom thereof but, obviously, including the slats 30. The soft upholstered covering 65 includes a soft layer of padding material 66, such as synthetic latex foam material, though other padding material may be utilized. The layer of padding 66 covers the sheet of latex foam material 50 and the entirety of the peripheral boundary piece of latex material 60. Fabric 67 can be appropriately quilted, as is indicated at Q in FIG. 1, to the padding layer 66 over the top and/or the peripheral side thereof, and a lower edge 68 (FIGS. 2–4) of the fabric material 67 is conventionally fastened to lower edges (unnumbered) of the frame members 14 through 17. Feet F (FIG. 4) can be secured in any conventional fashion to the frame 13 or the frame 13 can simply be supported by a conventional bed frame in the manner heretofore described. When thus supported with the mattress 12 thereatop, as shown in FIG. 1, the overall slat bed 10 has the appearance of a conventional United States or North American bed, yet excludes the conventional coil spring box spring thereof.

Although a preferred embodiment of the invention has been specifically illustrated and described herein, it is to be understood that minor variations may be made in the apparatus without departing from the spirit and scope of the invention, as defined by the appended claims.

What is claimed is:

1. A slat box spring comprising a substantially polygonal frame defined by opposite substantially parallel spaced side frame members and opposite substantially parallel spaced front and rear frame members, a plurality of spaced substantially parallel concavo-convex slats constructed from substantially flexible material disposed substantially within said frame, said slats each having an uppermost convex surface and a lowermost downwardly opening concave surface, synthetic latex foam material spanning said slats convex surfaces, and upholstery in the form of a soft cover covering said foam material and peripherally covering said frame members thereby imparting a conventional coil spring box spring appearance to said slat box spring.

2. The slat box spring as defined in claim 1 wherein said polygonal frame defines a substantially open bottom of said slat box spring.

3. The slat box spring as defined in claim 2 wherein said soft cover includes quilted fabric.

4. The slat box spring as defined in claim 2 wherein said synthetic latex foam material includes at least one projection projecting into a space between at least one pair of said plurality of slats.

5. The slat box spring as defined in claim 1 wherein said soft cover includes quilted fabric.

6. The slat box spring as defined in claim 5 wherein said synthetic latex foam material includes at least one projection projecting into a space between at least one pair of said plurality of slats.

7. The slat box spring as defined in claim 5 wherein said synthetic latex foam material includes at least one projection projecting into a space between at least one pair of said plurality of slats adjacent each of said front and rear members.

8. The slat box spring as defined in claim 5 wherein said synthetic latex foam material includes at least one projection projecting into a space between at least one pair of said plurality of slats, and latex foam material is devoid of projections at a midportion thereof.

9. The slat box spring as defined in claim 5 including a rail inboard of, along and below an uppermost edge of each of said side frame members; and ends of said slats being supported upon said rails.

10. The slat box spring as defined in claim 5 including means for transversely reinforcingly spanning said frame between said side members.

11. The slat box spring as defined in claim 5 including a center frame member disposed substantially midway between said side frame members, and said slats are located in spanning relationship between said center frame member and said side frame members.

12. The slat box spring as defined in claim 1 wherein said synthetic latex foam material includes at least one projection projecting into a space between at least one pair of said plurality of slats.

13. The slat box spring as defined in claim 1 wherein said synthetic latex foam material includes at least one projection projecting into a space between at least one pair of said plurality of slats adjacent each of said front and rear members.

14. The slat box spring as defined in claim 1 wherein said synthetic latex foam material includes at least one projection projecting into a space between at least one pair of said plurality of slats, and said latex foam material is devoid of projections at a mid portion thereof.

15. The slat box spring as defined in claim 1 wherein said synthetic latex foam material includes at least one elongated projection projecting into a space between at least two pair of said plurality of slats, and said elongated projections are in substantially parallel relationship to each other.

16. The slat box spring as defined in claim 1 including a rail inboard of, along and below an uppermost edge of each of said side frame members; and ends of said slats being supported upon said rails.

17. The slat box spring as defined in claim 1 including means for transversely reinforcingly spanning said frame between said side members.

18. The slat box spring as defined in claim 1 including a center frame member disposed substantially midway between said side frame members, and said slats are located in spanning relationship between said center frame member and said side frame members.

19. The slat box spring as defined in claim 1 wherein said soft cover includes a top and a peripheral skirt terminating in a lower peripheral edge defining an opening.

20. The slat box spring as defined in claim 19 including a layer of padding between said peripheral skirt and said frame members.

21. The slat box spring as defined in claim 19 including means for securing said lower peripheral edge to a lower edge of said polygonal frame.

22. The slat box spring as defined in claim 20 including means for securing said lower peripheral edge to a lower edge of said polygonal frame.

23. The slat box spring as defined in claim 19 wherein said soft cover includes quilted fabric.

24. The slat box spring as defined in claim 23 wherein said soft cover includes a top and a peripheral skirt terminating in a lower peripheral edge defining an opening.

25. The slat box spring as defined in claim 23 including a layer of padding between said peripheral skirt and said frame members.

26. The slat box spring as defined in claim 23 including means for securing said lower peripheral edge to a lower edge of said polygonal frame.

27. The slat box spring as defined in claim 25 including means for securing said lower peripheral edge to a lower edge of said polygonal frame.

* * * * *